US008220882B2

(12) United States Patent
Kropf et al.

(10) Patent No.: US 8,220,882 B2
(45) Date of Patent: Jul. 17, 2012

(54) DEVICE FOR LOCKING A FURNITURE PART AND FURNITURE

(75) Inventors: Peter Kropf, Hard (AT); Dieter Seewald, Walzenhausen (CH); Klaus Schneider, Höchst (AT)

(73) Assignee: Grass GmbH, Hochst/Voralberg (AT)

( * ) Notice: Subject to any disclaimer, the term of this patent is extended or adjusted under 35 U.S.C. 154(b) by 563 days.

(21) Appl. No.: 11/836,997

(22) Filed: Aug. 10, 2007

(65) Prior Publication Data

US 2008/0036345 A1 Feb. 14, 2008

(30) Foreign Application Priority Data

Aug. 10, 2006 (DE) ..... 20 2006 012 347 U

(51) Int. Cl.
*A47B 88/04* (2006.01)

(52) U.S. Cl. ..... 312/333

(58) Field of Classification Search ..... 312/330.1, 312/331, 332.1, 333, 334.1, 334.7, 334.44, 312/334.47, 319.1, 319.2, 216, 220, 221
See application file for complete search history.

(56) References Cited

U.S. PATENT DOCUMENTS

| | | | | |
|---|---|---|---|---|
| 4,159,153 | A * | 6/1979 | Yoshikawa | 312/333 |
| 6,227,630 | B1 * | 5/2001 | Brown et al. | 312/223.2 |
| 6,250,730 | B1 * | 6/2001 | Roth et al. | 312/333 |
| 6,375,290 | B1 * | 4/2002 | Lin et al. | 312/334.46 |
| 6,412,891 | B1 | 7/2002 | Liang et al. | |
| 6,997,527 | B2 * | 2/2006 | Cheng | 312/332.1 |
| 2004/0100165 | A1 * | 5/2004 | Hoffman | 312/219 |
| 2005/0100166 | A1 * | 5/2005 | Smetters et al. | 380/277 |

FOREIGN PATENT DOCUMENTS

| | | | |
|---|---|---|---|
| DE | 198 28 718 | A1 | 6/1998 |
| DE | 198 49 798 | A1 | 10/1998 |
| DE | 201 06 081 | U1 | 8/2001 |
| EP | 0 998 865 | B1 | 5/2000 |
| EP | 0766939 | * | 4/2003 |

* cited by examiner

*Primary Examiner* — James O Hansen
(74) *Attorney, Agent, or Firm* — Kilpatrick Townsend & Stockton

(57) ABSTRACT

A piece of furniture and a device for locking a first furniture part in a closing position in relation to a second furniture part, wherein the lock can be overridden using a triggering process. Releasing means are provided that are operable to unlock the first furniture part from the closing position by an externally applied, predetermined triggering force on the first furniture part in the opening direction of the first furniture part relative to the second furniture part, if the triggering process does not override the lock.

21 Claims, 4 Drawing Sheets

DEVICE FOR LOCKING A FURNITURE PART AND FURNITURE

FIELD OF THE INVENTION

The invention relates to a device for locking a first furniture part in a closing position in relation to a second furniture part, wherein the lock can he overridden using a triggering process.

BACKGROUND OF THE INVENTION

Pieces of furniture comprising furniture parts, which can move in relation to each other, for example, a furniture carcass, in which a drawer or pull-out tray is accommodated such that the drawer or pull-out tray can move by means of a guide, or cupboards comprising fittings for doors or flaps have been disclosed in various designs in the prior art. Furthermore, devices for such pieces of furniture are used, with which the movable furniture parts can be locked in a closing position, for example, in order to prevent an undesirable opening of the drawers, doors or the like at the hands of children, for example. For this purpose, a person can reopen the movable furniture parts in the locked position of the latter, for example, only after performing a defined triggering action. Locking mechanisms are also used in so-called alternate locking systems, when, for example, it is possible to open precisely only one of several drawers for each furniture carcass. When one drawer is open, the other drawers are kept locked or closed. This can be achieved, e.g., using a vertical rod in the carcass, which rod is provided with one swiveling unit for each drawer, which swiveling unit can block the corresponding drawer.

In pieces of furniture comprising so-called touch-latch arrangements for drawers, doors or flaps, e.g., the furniture part located in the arresting position can be released again into the opening position only when the movable furniture part is moved by a comparatively small distance, for example, by pressing the furniture part against the opening direction.

Particularly when a piece of furniture is equipped with a locking device, it may happen that the lock cannot be overridden, for example, due to a jamming or twisting of components or stored goods, which can move relative to each other. The unlocking mechanism can get blocked in electrically locked arrangements, e.g., during a disturbance in the power supply. In such cases, for example, an improper action on the piece of furniture can result in damages of the piece of furniture and the additional components thereof, or loss of the full functional capability of the moving, opening and closing mechanisms.

SUMMARY OF THE INVENTION

It is the object of the invention to improve the aforementioned piece of furniture and its possible applications and particularly provide a device, using which it is possible to prevent disturbances or adverse effects on the functioning of movable furniture parts.

The invention is based on a device for locking a first furniture part in a closing position in relation to a second furniture part, it being possible to override the lock using a triggering process. An essential aspect of the invention involves the provision of releasing means operable to unlock the first furniture part from the closing position by an externally applied, predetermined triggering force on the first furniture part in the opening direction of the first furniture part relative to the second furniture part, if the triggering process does not override the lock. It is thus possible to increase the reliability of the locking device and/or the operational comfort of pieces of furniture that are equipped as suggested by the invention. Particularly undesirable damage and malfunctions can be eliminated in locked and blocked movable furniture parts. The movable furniture part can also be opened and operated at all times during failure malfunctions of the release mechanism of the lock or the guided movement of the first furniture part. The triggering process can comprise, e.g., a relative movement of the first furniture part to the second furniture part or an actuation of actuating means, for example, a switch arrangement for a mechanical or electrical locking mechanism.

The triggering force is the force, which must be applied from the outside on the first furniture part, in order to be able to reopen the latter if it is blocked by the lock provided by default. Preferably the standard lock, which cannot be overridden using the triggering process, is bypassed, so to speak, and an alternative releasing mechanism is activated using the triggering force. The triggering force can also be referred to as an emergency unlocking force.

In addition to the emergency unlocking function, the suggested arrangement can also be used for opening the drawer when the releasing mechanism of the lock is not blocked at all. This may be the case, e.g., when the first furniture part can be opened by default only after successfully pressing the first furniture part in the closing direction. The suggested arrangement can thus also be used to open the first furniture part by pulling the same during its normal operation.

The locking means are preferably disposed on a receiving part and can be released out of a locking position relative to the receiving part in order to unlock the first furniture part relative to the second furniture part. With the help of a receiving part, the locking means can be mounted easily and fixed securely, e.g., on a furniture carcass or on a furniture part, which can be moved relative to the furniture carcass.

It is further suggested that the releasing means be designed in such a way that on applying the predetermined triggering force to the first furniture part, the first furniture part is unlocked using a resettable triggering movement of the receiving part. A triggering movement, e.g., brought about by swiveling out or displacing the receiving part vertically or horizontally can be achieved in a comparatively easy and space-saving manner. Particularly, the releasing means can be provided such that they allow for the unlocking mechanism of the receiving part at a defined triggering force and also assist in positioning the receiving part permanently in a basic position.

In principle, other mechanical releasing means can also be used, and the releasing means can also function magnetically or electrically.

In particular, the device according to the invention can be used to open the furniture part or to use the furniture part without adverse effects thereon even when the movable furniture part gets jammed or twisted, thereby making it impossible to override, e.g., the locking position of a touch-latch arrangement or when the unlocking function of, for example, a child safety lock or an alternative locking system fails. This feature is particularly advantageous when the movable furniture part must be opened immediately, e.g., in order to reach objects that must be accessible immediately. Examples of these objects include important medicines or documents. So far, a failure of the unlocking process of a movable furniture part out of a closing position could only be dealt with by resorting to corresponding time-consuming measures. Alternatively, the user had to unlock the drawer by applying force, and had to consequently put up with at least partial destruction or damage of the furniture part.

According to the invention, a predetermined triggering force applied from the outside on the first furniture part can override the lock of the related furniture part. In doing so, the specification of the force is selected such that, e.g., an adult can easily apply the triggering force to be reached. Furthermore, the required force for unlocking the first furniture part using the suggested releasing means is dimensioned that the occurring mechanical stresses do not cause any damage of the piece of furniture. It is advantageously also possible to protect the accidental or undesirable opening of the movable furniture part, for example, at the hands of children, and thus to provide a child safety lock for preventing access to the open furniture part. The necessary effort or the triggering force for overriding the lock can, for example, be substantially higher than that required for opening and unlocking conventionally guided movable furniture parts.

Another advantage of the device according to the invention is that the movable first furniture part can be unlocked and opened using an operating process that differs from the one used during normal operation. It is thus feasible to open the first furniture part in its arrested closing position both by pressing against the opening direction and also by pulling the first furniture part in the opening direction, for example, in so-called touch-latch arrangements.

Furthermore, the triggering movement of the receiving part for releasing the arrest is advantageously resettable, particularly at least in part or also fully automatically, e.g., using suitable spring mechanisms. It is thus possible to unlock the arresting position almost at random frequency in accordance with the invention. It is particularly advantageous if the receiving part and the locking means can be brought back, without resorting to any special measures, to their original initial position, in which a repeat emergency unlocking is possible according to the invention. If the triggering movement of the receiving part is not resettable fully automatically, the resetting can be effected, e.g., particularly by moving the drawer or the like as intended.

The releasing means and/or the locking means are preferably designed such that they can be reset by moving the first furniture part out of an unlocking position relative to the second furniture part into an initial position of the first furniture part relative to the second furniture part. A furniture part or an open drawer can be used, e.g., after a completed emergency unlocking process, for resetting the releasing means and/or the locking means during the next movement of the drawer or the next operating process, for example, subsequent further opening or closing processes. If both the releasing means and the locking means have to be reset, they can be reset jointly using, e.g., a closing movement or one after the other using, e.g., two successive movements of the first furniture part. Particularly, e.g., during the first closing process, the releasing means can be brought into their initial position, the locking means still remaining in their position e.g., a position in which the locking means are not reset or not unlocked relative to the releasing means. If the first furniture part is now moved slightly or by a comparatively short distance against the closing direction followed by a movement in the closing direction, then the locking means can also be brought into their initial position, in which they are reset or unlocked relative to the releasing means. This approach is particularly advantageous for performing a locking process using a touch-latch system.

It is further suggested that the releasing means comprise a detachable snap-on connection, using which the receiving part is held in a latching position against a holding section. A detachable snap-on connection easily and reliably enables the receiving part to be fixed, for example, directly or indirectly on the second furniture part. Detachable snap-on connections can be easily dimensioned and designed so as to precisely determine or adjust the force for detaching the existing snap-on connections. Furthermore, snap-on connections can be set up with a comparatively space-saving and rugged design. Usually the receiving part or the essential parts of the locking means are attached to the second or stationary furniture part. The locking means located on the receiving part can cooperate, for example, with those other parts of the locking means that are disposed on the movable furniture part in such a way that the first furniture part can couple with the locking means on the stationary furniture part and be locked or arrested in a closing position. In principle, however, the receiving part and the locking means can also be mounted in a reverse manner. It is thus possible to mount the receiving part with parts of the locking means on the movable or first furniture part.

In an advantageous embodiment of the object of the invention, the releasing means comprise a resilient latching element, which cooperates with a counter-section that is adapted to fit the latching element. Latching elements with springs are particularly suitable for setting up the detachable snap-on connection since the former require less installation space and operate reliably and effectively. Furthermore, resilient components are suitable for automatically latching or unlatching if the latching element is guided past corresponding counter-sections by way of example. Examples of resilient latching elements include inter alia a latching pin, which is accommodated, e.g., in a recess and which can move by yielding in its longitudinal direction over a spring positioned in the recess. Other examples of suitable resilient latching means include a leg spring or the like. The force or the connection stability, which can be achieved using the resilient latching element or which holds the receiving part in its latching position, can be set up incrementally, depending on the design of the resilient latching element. Furthermore, the shape or the length of a latching pin or the characteristic of a spring element acting on the latching pin can be dimensioned variably.

It is further preferred that the releasing means comprise a latching element, which can be moved together with the movement of the receiving part along a slide guide. The latching element performs the function of holding or accommodating the receiving part using a latching force and unlatching the receiving part when the triggering force is reached. In addition, the latching element can also be used for guiding the triggering movement of the receiving part. For example, a resilient latching pin can be provided on the receiving part for this purpose. The latching pin guides the receiving part by engaging in a corresponding guide on a component adjoining the receiving part. If the receiving part is unlocked by the externally imposed triggering force, for example, due to the retreat or unlatching of the resilient latching pin out of a latching contour in an adjoining component, the latching pin can arrive in a slide guide and can thus be moved along a defined path. The triggering movement of the receiving part can also bring the locking means disposed thereon into a position in which the first furniture part can be unlocked or released and, e.g., opened. The locking means can remain in their locking position relative to the receiving part. However, the locking means are brought with the receiving part spatially into a release position, in which the first furniture part is unlocked. It is also advantageously possible to move the receiving part back into its initial position with the help of the slide guide and the latching element guided therein.

In an alternative arrangement, the releasing means comprise a connection to a first shear element, which can shear off when the trigger force is applied. It is possible to provide a particularly easy and cost-effective solution using a shear element, which is sheared off due to the force applied from the outside on the first furniture part, thereby unlocking the first furniture part or, e.g., a drawer. This is because only, e.g., in the case of an emergency unlocking process, which occurs comparatively rarely, the destroyed shear element must be replaced with a new one in order to reestablish the prerequisites for a renewed unlocking process in the opening direction. In a simple case, the shear element can be designed, for example, for a plug connection, possible examples of shear elements including a simple metal pin or plastic pin or the like optionally with a predetermined breaking point. For example, depending on the shear element, it is possible to adjust the force with which the shearing process is effected and the emergency unlocking process is triggered.

Furthermore, it is particularly advantageous that the releasing means are designed such that the triggering force does not have a detrimental effect on the locking means and/or the receiving part. It is thus possible to prevent a damage of or an adverse effect on the components even in the case of an emergency unlocking process. Since the secure unlatching of the receiving part out of its latching position and thus the unlocking of the first furniture part are effected only on reaching or exceeding the predetermined force effect applied from the outside on the first furniture part as the triggering force, smaller external forces or tensile forces are transmitted to the first furniture part using the locking means or the receiving part or are absorbed by the furniture.

In an advantageous embodiment of the object of the invention, the locking means comprise a catch element, which can be coupled to the first furniture part and which can arrive together with the first furniture part into a secure displacement position for reaching the locking position. Such an arrangement is particularly reliable and rugged. Here, it is advantageous that the catch element can arrive into a coupling position with the first furniture part only shortly before the latter reaches its desired closing position. In other words, it is advantageous that the catch element is coupled with the first furniture part only temporarily. It is thus possible for the arrangement comprising the catch element to be disposed comparatively easily, for example, in a rear region of the furniture e.g., such that is can be swiveled or displaced in any other manner. Once the first furniture part approaches the locking position, the catch element can be coupled to or can hold on to the first furniture part and be brought into a subsequently releasable locking position, in which the first furniture part is, e.g., closed. The locking position can be released thereafter e.g., by applying a counter-pressure against the first furniture part or in any other manner, e.g., by actuating an unlocking switch.

It is particularly preferable that the locking means comprise a touch-latch arrangement. A touch-latch arrangement is particularly advantageous for arrangements involving a high level of operating comfort. Furthermore, movable first furniture parts can be designed in a visually appealing manner without handles or handle strips and the like, since the movable first furniture parts can be detached out of a locking position by merely applying slight counter-pressure, for example, against the front side. Furniture having touch-latch arrangements can hitherto be opened with difficulty, if corresponding components jammed or rendered the unlocking process impossible. It is then frequently necessary to resort to improper measures to unlock the first furniture part, which inevitably involved a damage of the furniture or guides or parts of the touch-latch arrangement from getting damaged.

If a touch-latch arrangement is provided, particularly the locking means can form a part of the touch-latch arrangement. If a touch-latch arrangement is used, the first furniture part can be released out of the locking position in the described manner by applying a counter-pressure against the first furniture part and also by pulling the first furniture part or the drawer in the opening direction thereof. For introducing tensile forces on the first furniture part, the latter can be provided with necessary measures, if appropriate, for example, a handle strip, a handle or a projecting front part which can be grasped from behind.

It is also feasible to open the drawer using a suction cup or auxiliary means, which can be inserted or rotated sideways or behind the front of the drawer. If several drawers are present, it is also possible to open a drawer which is adjoining above, below or to the side of the jammed drawer so as to obtain access to the front of the jammed drawer and be able to open the same by pulling it.

The receiving part and the locking means can advantageously swivel about a common axis. It is thus possible to further simplify the overall layout, which additionally requires relatively less installation space. Furthermore, it is possible, for example, to provide existing furniture with touch-latch arrangements comprising one or two swiveling locking levers particularly easily with the device according to the invention or to subsequently retrofit existing furniture with the device according to the invention, if appropriate.

Based on a device for locking a first furniture part in a closing position relative to a second furniture part, it being possible to override the lock using a triggering process, another essential aspect of the invention involves the provision of releasing means operable to unlock the first furniture part from the closing position by an externally applied, predetermined triggering force on the first furniture part in the opening direction of the first furniture part relative to the second furniture part, the releasing means comprising a detachable snap-on connection. A detachable snap-on connection can be set up in an easy and space-saving manner and is particularly characterized by a comparatively high degree of reliability. Particularly advantageously, the aforementioned arrangement with the detachable snap-on connection, which engages in the case of an emergency unlocking process, can also be provided without the superordinate lock for securing the lock, e.g., by means of a touch-latch arrangement. Then the above arrangement designed as an emergency unlocking system functions, so to speak, as the actual or sole lock of the first furniture part. It is thus also possible, for example, to achieve a type of child safety lock, e.g., in which an adult can override the latching force of the detachable snap-on connection. However, this is not easily possible for a child to accomplish.

The invention further relates to a piece of furniture comprising an aforementioned device. Particularly, pieces of furniture comprising pull-out drawers, pull-out trays or doors or flaps can thus be designed so as to avail of the aforementioned advantage.

BRIEF DESCRIPTION OF THE DRAWINGS

The following additional features and advantages of the invention will be explained in more detail in the figures of the drawings, in which:

FIG. 7: is a detailed side view of a part of the device according to the invention according to the position shown in FIG. 5, FIG. 8: is a sectional representation of the device shown in FIG. 7 taken along the line A-A marked in FIG. 7, FIG. 9: is an exploded, perspective, oblique top view of the arrangement shown in

FIG. 7.

DETAILED DESCRIPTION

Figure 1:
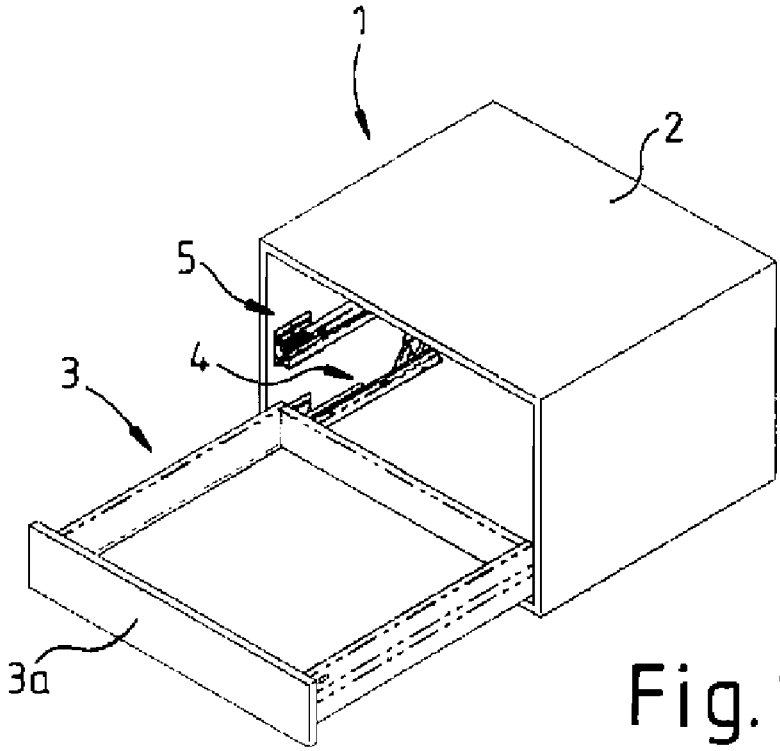
FIG. 1: is a perspective top view of a furniture carcass comprising an open drawer.

FIG. 1 schematically shows a piece of furniture 1 comprising a furniture carcass 2 and a drawer 3, which can be guided by moving it in the furniture carcass. The drawer 3 disposed in the lower region of the furniture carcass 2 is shown in its open state and is guided by moving it over two lateral guide rails in the furniture carcass 2. Only one guide rail 4 of the two lateral guide rails is shown in FIG. 1. FIG. 1 further shows one guide 5 from among two other guides above the guide 4 in the furniture carcass 2 for receiving another drawer (not shown). The guides 4 and 5 comprise, in particular, a carcass rail attached permanently to the furniture carcass 2, a drawer rail attached to the drawer 3 and, if appropriate, a middle rail acting between the carcass rail and the drawer rail. The drawer 3 is provided with a so-called touch-latch arrangement and therefore does not have, for example, any handle on its front panel 3*a*. As will be explained in more detail below, an operator can unlock the drawer 3 when it is in its closed position, in which it is locked using the touch-latch arrangement, in the furniture carcass 2 by pressing the front panel 3*a* in the failure-free, normal operation of the drawer. Once the drawer 3 is unlocked, it can be pulled out, for example, using a charged energy storage element or a press-in element. The charged energy storage element or the press-in element (not shown) could be disposed, e.g., at the front end of the drawer rail and could abut against a stop disposed on the carcass rail.

Figure 2:
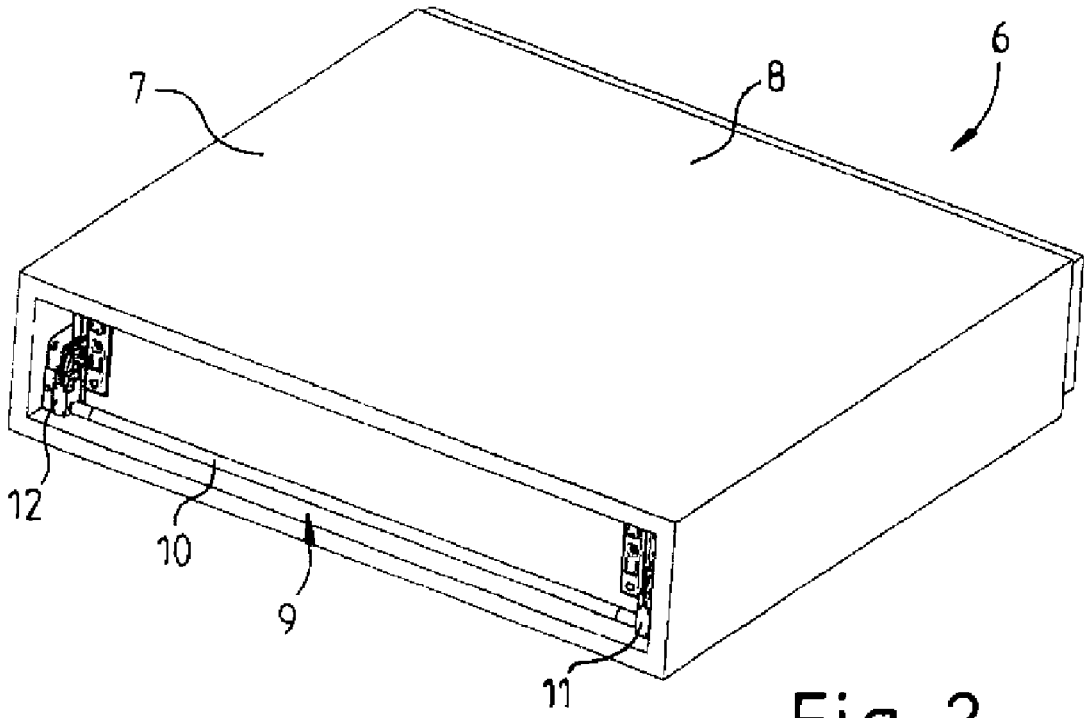
FIG. 2: is a perspective rear view of a drawer according to the invention in a furniture carcass comprising a device of the invention.

FIG. 2 shows another piece of furniture 6 comprising a furniture carcass 7 and a drawer 8 that can be displaced therein. The piece of furniture 6 has a locking device 9 comprising a synchronization rod 10, a holding part 11, which is fixed or screwed permanently to the furniture carcass, and a displaceable or unlatchable locking part 12, between which the synchronization rod 10 is positioned. The synchronization rod 10 synchronizes the swiveling movement of two breech catches 21 and 22, which will be explained below in more detail.

Figure 3:
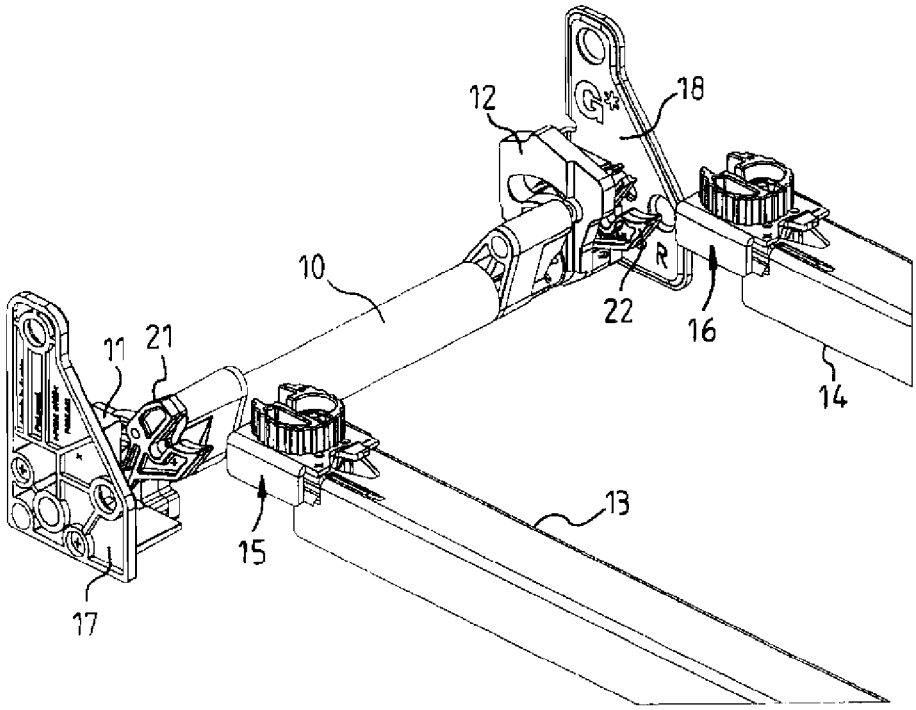
FIG. 3: is a detailed perspective, oblique, front view of a section of a pull-out guide comprising the device according to the invention, the pull-out guide being in an extended position.

FIG. 3 is a perspective, detailed view of the locking device 9 and a portion of the rear end sections of two drawer rails 13 and 14, which are each fixed to the drawer 8 (not shown in the subsequent figures). The furniture carcass 7 is also not shown in the subsequent figures. The rear end of the drawer rail 13 has an adjustable coupling element 15, and the drawer rail 14 has a corresponding coupling element 16. The holding part 11 can be fixed permanently to the furniture carcass 7 using screw holes and a holding plate 17 that is designed as a single piece with the holding part 11. For example, the holding part 11 can be fixed to the inner wall of the furniture carcass 7 or indirectly to the furniture carcass, e.g., to a part of a carcass rail or a screw-on bracket provided for the same purpose on the carcass rail. The locking part 12 is disposed on a holding plate 18 such that the former 12 can be displaced or swiveled using a snap-on connection, which will be described below in more detail. The holding plate 18 can likewise be fixed directly to the furniture carcass or, for example, to parts of a carcass rail. FIG. 3 shows the unlocked position of the drawer 8, the locking part 12 being latched in its non-swiveled position on the holding plate 18.

Figure 4:
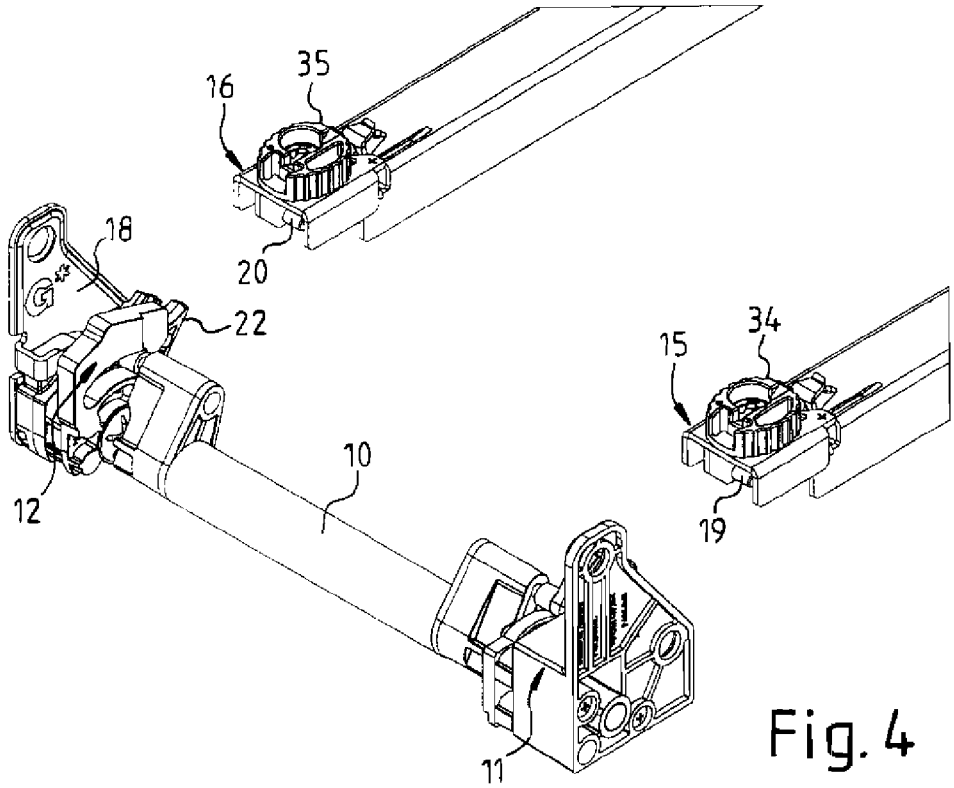
FIG. 4: is another perspective rear view of the arrangement shown in FIG. 3, FIG. 5: is a detailed view of the pull-out guide comprising the device according to the invention shown in FIG. 3, the pull-out guide being in a locked position.

FIG. 4 shows a perspective rear view of the arrangement shown in FIG. 3. The coupling elements 15, 16 each have an engaging roller 19, 20, which can each engage in swiveling breech catches 21, 22 respectively for achieving a touch-latch arrangement, when the drawer 8 has arrived in its closing position. FIGS. 3 and 4 show the position of the locking devices 9 and the breech catches 21, 22 in the unlocked position or when the drawer is located in its open position during normal operation. The engaging rollers 19, 20, the breech catches 21, 22 and the synchronization rod 10 can function, for example, similarly to the touch-latch arrangements disclosed in the prior art.

Figure 5:
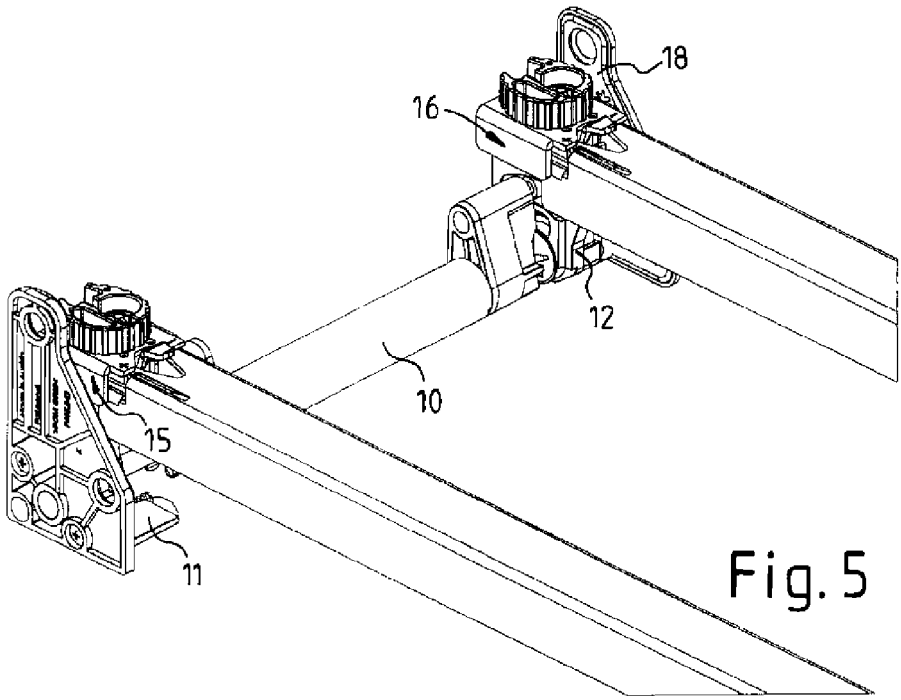
Figure 6:
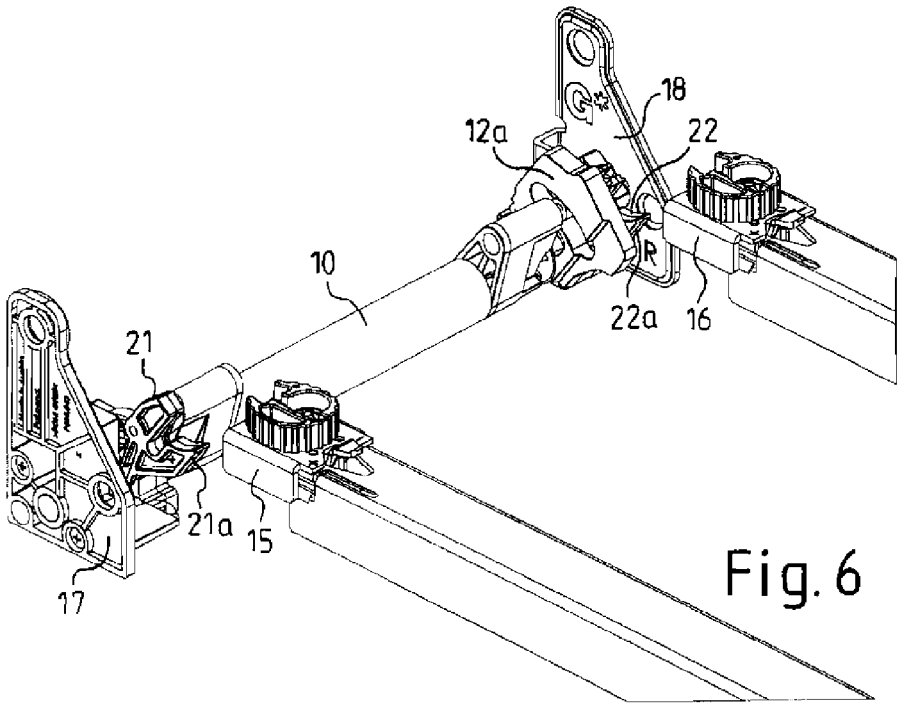
FIG. 6: shows the arrangement shown in FIG. 5, however, after an unlocking process is performed using the device according to the invention.

When the drawer 8 is pushed backwards into the carcass 7, for example, starting from the position shown in FIGS. 3 and 4, the drawer rails 13, 14 move with the coupling elements 15, 16 towards the spring-loaded breech catches 21, 22 in such a way that the engaging rollers 19, 20 engage in the breech catches 21, 22, couple with the latter and arrive into a locked position or a position in which the breech catches 21, 22 are securely swiveled backwards (see FIG. 5). The breech catches 21, 22 swivel backwards and hold the engaging rollers 19, 20 in an arrested position, thereby also arresting the corresponding drawer 8 in a closing position in the furniture carcass 7. If a jamming or twisting of the components in the piece of furniture 6 leads, for example, to a malfunction of the unlocking mechanism of the touch-latch arrangement, due to which the breech catches 21, 22 cannot be swiveled forwards out of the position shown in FIG. 5 and into the position shown in FIGS. 3 and 4, it is possible to trigger an emergency opening or emergency unlocking mechanism according to the invention. After triggering the emergency unlocking mechanism according to the invention, the arrangement shown in FIG. 5 arrives into an emergency unlocking position shown in FIG. 6. The emergency unlocking is brought about by pulling the drawer 8 forwards or in the opening direction. In doing so, the engaging roller 20 acts on the breech catch 22 in such a way that the displaceable locking part 12 is unlatched out of its latching position (shown in FIG. 5) on the holding plate 18. The locking part 12 can be slightly swiveled forwards together with the breech catch 22, and the breech catch 22 releases the engaging roller 20, thereby also enabling the drawer 8 to be opened. The breech catch 22 is thus swiveled forwards together with the locking part 12 while retaining its latched position in relation to the locking part 12. This enables the emergency unlocking of the touch-latch arrangement. The breech catch 21 is slightly swiveled forwards by means of the synchronization rod 10 corresponding to the movement of the breech catch 22, thereby also releasing the engaging roller 19 simultaneously. For this purpose, the breech catch 21 can be swiveled forward under spring load without the possibility of getting arrested against the holding part 11.

Figure 7:
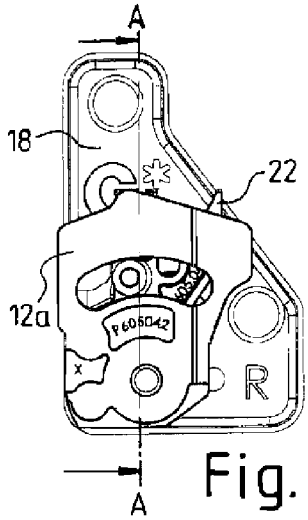
Figure 8:
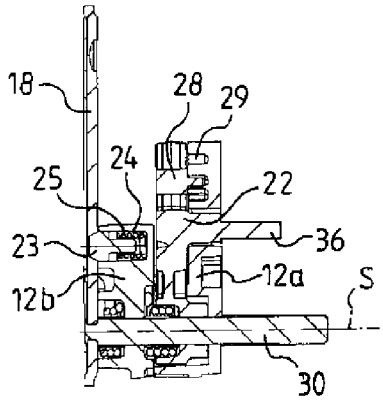
Figure 9:
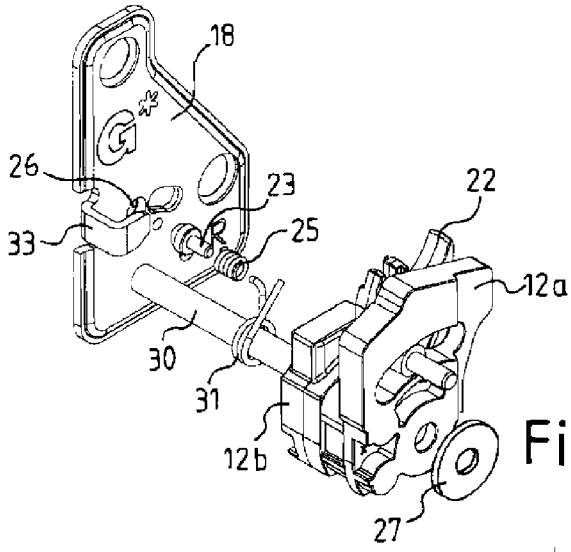

FIG. 7 shows the holding plate 18 with the displaceable locking part 12 and the breech catch 22 in the locked position shown in FIG. 5. As is also clearly evident particularly from FIGS. 8 and 9, the breech catch 22 is accommodated between the permanently interconnected slide part 12*a* and a latching part 12*b* of the locking part 12, which are firmly connected with each other, in such a way that the breech catch 22 swivels about an axis "S". For achieving the emergency unlocking position shown in FIG. 6, the locking part 12 or the latching part 12*b* must be unlatched out of the latching position shown in FIGS. 7 and 8. For this purpose, it is necessary to override the latching position of the locking part 12, which latching position is set up on the latching part 12*b* using a resilient latching pin 23. The latching pin 23 is received in a bore 24 in the latching part 12*b* in such a way that the latching pin 23 protrudes from the bore 24. The latching pin 23 is accommodated resiliently over a spiral spring 25 in the bore 24. In the locked position of the locking part 12, the latching pin 23 engages in a round bore 26 of the holding plate 18 and in doing so abuts, e.g., against an inner wall of the furniture carcass 7. In principle, the round bore 26 could also be designed as a recess in the holding plate 18.

The breech catch 22 is guided on the slide part 12*a* with the help of a pin 28, which is displaceably received in the slide part 12*a*, using recesses designed as guide grooves 29. The breech catch 22 can be arrested in an arresting position in the locking part 12 in that position of the breech catch 22, in which the breech catch 22 has swiveled backwards almost completely, which corresponds to the illustration of FIGS. 5 and 7.

A pivot pin 30 is provided on the holding plate 18 such that the pivot pin 30 is disposed perpendicularly to the flat side of the holding plate 18. The locking part 12 with the breech catch 22 is fitted on the pivot pin 30. A pressure spring 31 accommodated on the pivot pin 30 is positioned in such a way that in the unlocked position of the locking part 12 shown in FIGS. 10 and 11, the pressure spring 31 pushes the latching pin 23 in a curved elongated hole 32 out of a lower position shown in FIG. 11 into an upper position (not shown), which is located at the level of the round bore 26. In this position, the latching pin 23 can snap back into the round bore 26 easily and securely when the drawer is pushed back in. For this purpose, during the next pushing-in movement of the drawer 8, the engaging rollers 19, 20 due to synchronization, abut against contact surfaces 21*a*, 22*a* of the breech catches 21, 22 respectively. The breech catch 22 is pressed together with the locking part 12 into that position of the locking part 12, in which the locking part 12 is swiveled backwards so that the latching pin 23 can be unlatched out of its upper position in the elongated hole 32 and get latched in the round bore 26. The latching pin 23 springs back temporarily against the spring force of the spiral spring 25 in order to bridge the intermediate region between the elongated hole 32 and the round bore 26. Once the latching pin 23 is latched in the round bore 26, and the locking part 12 has thus moved back into its initial position, the additional counter-pressure of the engaging roller 20 against the contact surface 22*a* causes the breech catch 22 to be released out of its arrested position in relation to the locking part 12 and snap back slightly into its initial position or unlocked position. In this position, the breech catch 22 can again catch the engaging roller 20, couple with the latter and arrive into its arresting position, during the next pushing-in movement of the drawer 8.

During the triggering or unlocking movement of the locking part 12 with the breech catch 22, which is permanently arrested therewith, the breech catch 22 can be swiveled forwards at most by an angle $\alpha$ (see FIG. 11), the latching pin 23 arriving out of the round bore 26 and into the lower position in the elongated hole 32. The maximum swiveling angle or torsion angle $\alpha$ of the locking part 12 is determined by the position of the round bore 26 or of the elongated hole 32 or by the length of the elongated hole 32, can be adjusted variably, and is in the range of, e.g., approx. 30 angular degrees. For securely accommodating the latching part 12*b* in the normal position or in the position in which the latching pin 23 is latched in the round bore 26, a corresponding U-shaped holding collar 33 is designed on the holding plate 18 against which holding collar 33 the latching part 12*b* can abut.

The coupling elements 15 and 16 comprise adjusting wheels 34, 35 respectively, using which the position of the engaging rollers 19, 20 can be fine-tuned relative to the respective drawer rails 13, 14 in the longitudinal direction thereof. A depth adjustment, for example, of approx. +/−3 mm is thus possible, particularly for each drawer rail 13, 14, it being also possible to adjust an opening gap between a front edge of the furniture carcass 7 and the front of the drawer 8. This is necessary particularly for pressing in the drawer in a touch-latch arrangement and serves for compensating for optionally occurring deviations from ideal mounting positions of the carcass rail or the drawer rail.

For synchronizing the movement of the two breech catches 21, 22, the synchronization rod 10 is accommodated on corresponding pin sections, for example, on a pin 36 (see FIG. 8) on the slide part 12*a*, which pin 36 is oriented particularly parallel to the pivot pin 30. The synchronization rod 10 is further received rotatably on the pivot pin 30 or on an appropriately positioned pivot pin on the breech catch 21.

Figure 10:
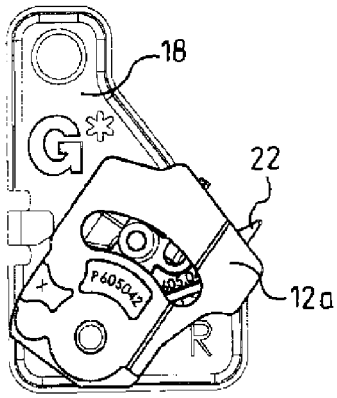
FIG. 10: shows the arrangement shown in FIG. 7 after an unlocking process is performed using the device according to the invention.
Figure 11:
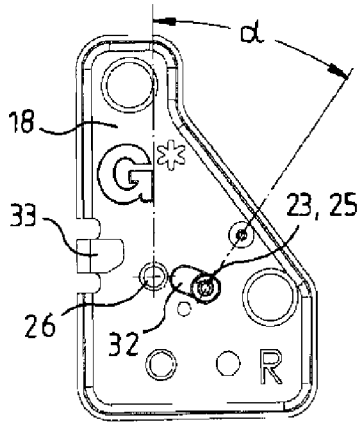
FIG. 11: shows the arrangement shown in FIG. 10 with the omission of individual components.

The contact pressure of the locking part 12 in relation to the holding plate 18 can be adjusted using a fixing disk 27 on the pivot pin 30, thereby also influencing the force required to bring the locking part 12 out of its initial position shown in FIG. 7 into the triggered position shown in FIG. 10 by pulling the drawer 8. In particular, the entire arrangement must be adjusted in such a way that other components, for example, the breech catch 22 or the engaging roller 20 are not damaged.

In principle, a touch-latch arrangement can also be provided only on one side of a drawer. Then there would also be no requirement of providing a synchronization rod, e.g., in relatively narrow drawers.

It is likewise conceivable to provide an emergency opening arrangement on each side of the drawer.

The emergency opening mechanism according to the invention can also be combined with a child safety lock or an alternate locking system.

LIST OF REFERENCE NUMERALS

1 Piece of furniture 29 Guide groove
2 Furniture carcass 30 Pivot pin
3 Drawer 31 Pressure spring
3*a* Front panel 32 Elongated hole
4 Guide 33 Holding collar
5 Guide 34 Adjusting wheel
6 Piece of furniture 35 Adjusting wheel
7 Furniture carcass 36 Pin
8 Drawer
9 Locking device
10 Synchronization rod
11 Holding part
12 Locking part

12*a* Slide part
12*b* Latching component
13 Drawer rail
14 Drawer rail
15 Coupling element
16 Coupling element
17 Holding plate
18 Holding plate
19 Engaging roller
20 Engaging roller
21 Breech catch
22 Breech catch
23 Latching pin
24 Bore
25 Spiral spring
26 Round bore
27 Fixing disk
28 Pin

What is claimed is:

1. Device for locking a first furniture part in a closing position in relation to a second furniture part, wherein a lock can be overridden using a triggering process, said device comprising:

locking means disposed on a receiving part and operable to be released out of a locking position relative to the receiving part by the triggering process which includes application of an externally applied first triggering force in the closing direction of the first furniture part in order to unlock the first furniture part relative to the second furniture part; and releasing means operable to unlock the first furniture part from the closing position by an externally applied, predetermined second triggering force on the first furniture part in an opening direction of the first furniture part relative to the second furniture part, if the triggering process does not override the lock and wherein the releasing means are designed such that when the predetermined second triggering force is applied to the first furniture part, the first furniture part is unlocked by means of a resettable triggering movement of the receiving part.

2. Device according to claim 1, wherein at least one of the releasing means and the locking means are designed such that they can be reset by moving the first furniture part out of an unlocking position relative to the second furniture part into an initial position of the first furniture part relative to the second furniture part.

3. Device according to claim 1, wherein the releasing means further comprise a detachable snap-on connection by means of which a receiving part is held in a latching position against a holding section.

4. Device according to claim 1, wherein the releasing means further comprise a resilient latching element which cooperates with a counter-section adapted to fit the latching element.

5. Device according to claim 1, wherein the releasing means further comprise a latching element which is moved together with a movement of a receiving part along a slide guide.

6. Device according to claim 1, wherein the releasing means further comprise a connection to a shear element, which can shear off once the triggering force is applied.

7. Device according to claim 1, wherein the releasing means are designed such that the second triggering force does not have a destructive effect on either of the locking means and the receiving part.

8. Device according to claim 1, wherein the locking means further comprise a catch element, which can couple the first furniture part into a secure displacement position in order to achieve the locking position.

9. Device according to claim 1, wherein the locking means further comprise a touch-latch arrangement.

10. Device according to claim 1, wherein the receiving part and the locking means can swivel about a common axis.

11. Piece of furniture comprising a device according to claim 1.

12. Device for locking a first furniture part in a closing position in relation to a second furniture part, wherein a lock can be overridden using a triggering process, comprising:

locking means disposed on a receiving part and operable to be released out of a locking position relative to the receiving part by the triggering process which includes application of an externally applied first triggering force in the closing direction of the first furniture part in order to unlock the first furniture part relative to the second furniture part; and releasing means operable to unlock the first furniture part from the closing position by an externally applied, predetermined second triggering force on the first furniture part in an opening direction of the first furniture part relative to the second furniture part, the releasing means further comprising a detachable snap-on connection, which can be unlatched using a swiveling movement and wherein the releasing means are designed such that when the predetermined second triggering force is applied to the first furniture part, the first furniture part is unlocked by means of a resettable triggering movement of the receiving part.

13. Piece of furniture comprising a device according to claim 12.

14. Device according to claim 12, wherein at least one of the releasing means and the locking means are designed such that they can be reset by moving the first furniture part out of an unlocking position relative to the second furniture part into an initial position of the first furniture part relative to the second furniture part.

15. Device according to claim 12, further comprising a catch element coupled to the first furniture part and adapted to move with the first furniture part into a secure displacement position in order to achieve the locking position.

16. Device according to claim 12, wherein the releasing means further comprise a resilient latching element which cooperates with a counter-section adapted to fit the latching element.

17. Device according to claim 12, wherein the releasing means further comprise a latching element which is moved together with a movement of a receiving part along a slide guide.

18. Device according to claim 12, wherein the releasing means are designed such that the second triggering force does not have a destructive effect on either of the locking means and the receiving part.

19. Device according to claim 12, wherein the locking means further comprise a touch-latch arrangement.

20. Device according to claim 12, wherein the receiving part and the locking means can swivel about a common axis.

21. A device for locking and unlocking a first furniture part in a closing position in relation to a second furniture part by a triggering process through an externally applied first triggering force in a closing direction of the first furniture part, the device comprising:

a locking element that can swivel about an axis;

a coupling element comprising a protrusion;

a catch element that receives and engages the protrusion such that upon the engaging of the protrusion and the catch element, the catch element can swivel about an axis into the closing position latched together with the locking element, wherein the locking element and the catch element can swivel about the same axis; and releasing means operable to unlock the first furniture part from the closing position by an externally applied, predetermined second triggering force on the first furniture part in an opening direction of the first furniture part relative to the second furniture part, if the triggering process of the first furniture part does not override the lock.

* * * * *